United States Patent [19]

Kwasniak

[11] 4,349,960

[45] Sep. 21, 1982

[54] RAFT KNIFE

[76] Inventor: Wesley Kwasniak, 5979 SW. 56 St., Miami, Fla. 33155

[21] Appl. No.: 218,277

[22] Filed: Dec. 19, 1980

[51] Int. Cl.[3] ..... B26B 11/00

[52] U.S. Cl. ..... 30/153; 30/296 A; 114/80

[58] Field of Search ..... 9/2 A, 11 R, 11 A, 14; 30/153, 296 A, 123, 127, 151, 231; 224/232

[56] References Cited

U.S. PATENT DOCUMENTS

| | | | |
|---|---|---|---|
| 226,994 | 4/1880 | Frary | 30/123 |
| 293,634 | 2/1884 | Cowie | 30/296 A |
| 1,200,079 | 10/1916 | Christensen | 30/153 X |
| 2,198,664 | 4/1940 | Fogarty | 30/127 |
| 3,378,865 | 4/1968 | Pigg | 9/14 |

*Primary Examiner*—Jimmy C. Peters

*Attorney, Agent, or Firm*—John Cyril Malloy

[57] ABSTRACT

A raft knife and pocket structure to be fixed to a raft, such as an inflatable aircraft, and which is for use in severing a main tether between the raft and an aircraft, and which is composed of a pocket structure adapted to be fixed to the raft and in which pocket structure, which includes flaps which open and close and are adapted to close about a knife, there is a knife which is buoyant and which includes a recess which is spanned by a blade for use in cutting the raft from the main tether connecting it to an aircraft.

8 Claims, 3 Drawing Figures

RAFT KNIFE

FIELD OF THE INVENTION

This invention relates to knives and, more particularly, to a knife combination with a pocket structure for use on an inflatable raft.

BACKGROUND OF THE INVENTION

In the past there have been numerous types of knives and this invention is of a knife which is provided with a blade which is protectively within the handle so that, when used on an inflatable aircraft raft, for example, the blade will not inadvertently puncture the raft in use. Such a knife is important on a raft because when it is thrown, for example, from an aircraft in an emergency situation, such as a forced landing at sea, the raft must be connected to the aircraft so that it does not float away. On the other hand, if the aircraft is to sink, then the tether must be cut so that the raft does not go down with the aircraft. For this reason a knife is important to be among the emergency equipment on an inflatable raft used by an aircraft. This invention is of a knife which is configured, constructed and adapted for such a purpose.

OBJECTS OF THIS INVENTION

Generally speaking, it is an object of this invention to provide a raft knife which is simple and inexpensive to manufacture, embodies a pocket structure and houses a blade within the handle which is protectively arranged within a recess in the handle so as to be usable for purposes of cutting a line or tether and which must be manipulated in a particular manner by reason of the configuration of the knife so that the blade of the knife will not inadvertently puncture the inflatable raft, as is set forth more fully hereinafter.

In accordance with these and other objects which will become apparent hereinafter, the instant invention will now be described with reference to the accompanying drawings in which:

DESCRIPTION OF THE PREFERRED EMBODIMENT

Figure 1:
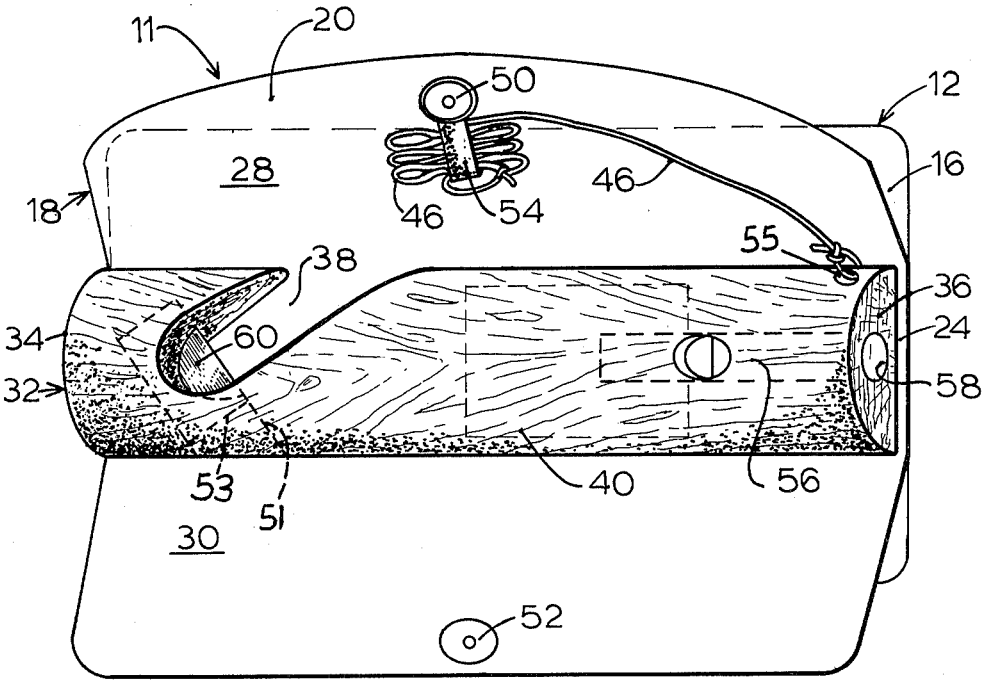
FIG. 1 is a perspective view of the invention shown with the pocket in an open attitude.
Figure 2:
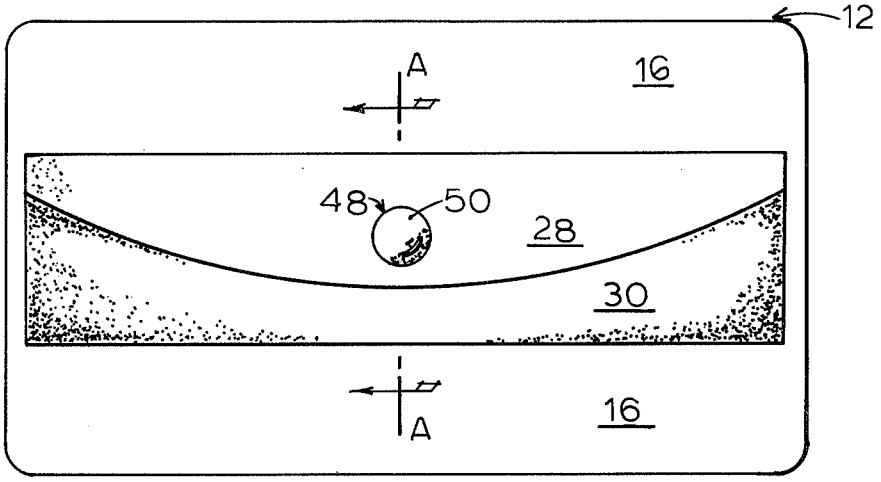
FIG. 2 is a front elevation view of the invention with the pocket in a closed attitude.

Referring to the drawings wherein like reference characters designate like or corresponding parts throughout the several views and referring particularly to FIG. 1, the numeral 11 represents the invention generally which is composed of (a) a patch 12, having a front main surface 16 and a rear main surface 14; (b) a pocket structure 18, having an inside surface 20 and an outside surface 22, and which pocket structure is secured to the front main surface 16 of the patch along the respective central zones of the patch 26 and pocket 22; (c) a knife handle 32 having a first and second end 34 and 36, which handle is provided with a recess generally designated by the numeral 38 or bight defining a generally hook-shaped handle and which bight is adjacent the first end and in which a blade 60 is captivated;

(d) means to releasably connect the knife to the pocket structure preferably; and (e) a tether 46 fixed as in the hole 55 in the knife handle and, at the other end, to the pocket structure as at the loop means 54.

Figure 3:
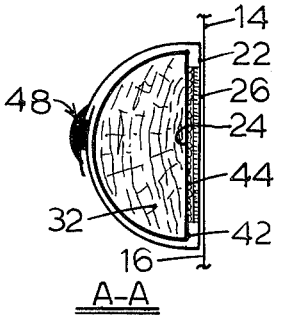
FIG. 3 is a view taken on the plane indicated by the line A—A of FIG. 2 and looking in the direction of the arrows.

In the preferred embodiment, the pocket structure is composed of the elongate central zone 22 and the first and second flap 28 and 30 extending from the central zone and adapted to fold about the knife. Snap means 48 including a male and a female portion 52 and 50, or other type quick release fastener, to normally close the pocket structure. At the rear face 42 of the flat knife handle in the central zone 44, fastener means are provided, preferably companionate hook and eye patches, which are available commercially and known under the trademark Velcro, as is designated by the numeral 40 in FIG. 1 and seen also in FIG. 3.

The knife blade 60 is seen to be in spanning relation and protectively within the recess 36 which guards against it inadvertently slicing into an inflatable raft to which the patch together with the pocket structure may be installed. The blade is snugly seated in the slot shown by the dotted line 51. Pressure upon the exposed blade of the knife 60 seats it against the slot wall or floor 53.

In the preferred embodiment, the patch is adapted to be secured to the inside of a life raft, such as that which is thrown from an airplane. Initially, when the raft is thrown from an airplane, it is tied to the aircraft by a tether. Of course, this must be severed before the aircraft sinks or it will take the raft down with it. For this reason, such a raft should be provided with a knife to cut the tether to the aircraft. The patch of this invention is adapted as by heat-sealing to be secured to the raft. This may be done by any suitable means. The patch carries the knife structure fixed to it and within which the knife is provided. The location of the knife blade in the handle protectively guards against it being inadvertently likely to cut the raft, such as an inflated raft. The tether is provided so that the knife cannot be lost accidentally, such as if it falls overboard when a person is cutting the main tether to the aircraft. Also, in the preferred embodiment, as shown, a whistle structure in the form of a recess 58 which is elongated as indicated by 56 leading to an outlet is provided so that to attract the attention of others, the whistle may be blown to cause a loud audible signal. In the preferred embodiment the length of the knife is about 5 inches and is composed of a half wood dowel of a flat surface dimension of about one and one-quarter inches and of about five-eighths of an inch in height. The tether may be any suitable strong, durable string. The Velcro patch is about one and one-half inches in elongate length along the knife as well as the inside of the pocket structure and it is about one inches across being centered along the main length of the flat surface of the knife.

While the instant invention has been shown and described herein in what is conceived to be the most practical and preferred embodiment, it is recognized that departures may be made therefrom within the scope of the invention, which is therefore not to be limited to the details disclosed herein but is to be accorded the full scope of the claims so as to embrace any and all equivalent apparatus and articles.

What is claimed is:

1. A knife in combination with a pocket structure to be fixed to a raft, said pocket structure including a central zone and means attached to the central zone for fixing the pocket structure to a raft, said pocket structure comprising a pair of flaps, adapted to open and close the pocket and including means to close the pocket and maintain it in closed relation, a buoyant knife having a first end and a second end and a recess adjacent the first end, said recess having a blade within said recess and spanning said recess, tether means to secure the knife and said pocket structure, said tether means including a first end connected to the knife and a second end connected to the pocket structure.

2. The device as set forth in claim 1 wherein said means to attach to a raft comprises a patch secured to said pocket structure and said patch being adapted to be secured to a raft surface.

3. The device as set forth in claim 1 wherein means are provided to releasably hold the knife in the pocket.

4. The device as set forth in claim 1 wherein said tether means comprises a string secured to the knife and to said pocket structure at opposite ends of said string.

5. The device as set forth in claim 1 wherein said buoyant knife comprises a handle and said handle is of wooden material.

6. The device as set forth in claim 5 wherein said wooden material is of a half round cut configuration.

7. The device as set forth in claim 1 wherein said recess defines a generally hook-shaped knife handle.

8. The device as set forth in claim 1 wherein said recess extends from a zone adjacent said first end toward said first end and a slit is provided in said buoyant knife in communication with the interior of said recess, said slit being sized and adapted for insertion of said blade within said handle and in spanning relation of said recess.

* * * * *